United States Patent [19]

Yamashita et al.

[11] Patent Number: 5,054,302

[45] Date of Patent: Oct. 8, 1991

[54] HARDNESS COMPENSATED THICKNESS CONTROL METHOD FOR WET SKIN-PASS ROLLED SHEET

[75] Inventors: Michio Yamashita; Kunio Isobe; Ikuo Yarita, all of Chiba, Japan

[73] Assignee: Kawasaki Steel Corporation, Hyogo, Japan

[21] Appl. No.: 500,414

[22] Filed: Mar. 28, 1990

[30] Foreign Application Priority Data

| | | | |
|---|---|---|---|
| Apr. 7, 1989 | [JP] | Japan | 1-867.17 |
| Oct. 23, 1989 | [JP] | Japan | 1-273861 |
| Oct. 23, 1989 | [JP] | Japan | 1-273867 |
| Nov. 6, 1989 | [JP] | Japan | 1-287400 |

[51] Int. Cl.[5] ..... B21B 37/02

[52] U.S. Cl. ..... 72/8; 72/16; 72/365.2

[58] Field of Search ..... 72/8, 7, 10, 16, 12, 72/234, 365.2, 366.2

[56] References Cited

U.S. PATENT DOCUMENTS

| | | | |
|---|---|---|---|
| 1,814,354 | 7/1931 | Webster et al. | 72/16 |
| 3,169,424 | 2/1965 | Branscon et al. | 72/16 |
| 3,309,906 | 3/1967 | Bernick et al. | 72/365.2 |
| 3,453,858 | 7/1969 | Matsudo et al. | 72/365.2 |
| 3,665,743 | 5/1972 | Frohling | 72/16 |
| 3,869,892 | 3/1975 | Higham et al. | 72/16 |

FOREIGN PATENT DOCUMENTS

| | | | |
|---|---|---|---|
| 0932432 | 8/1973 | Canada | 72/16 |
| 0045515 | 3/1980 | Japan | 72/16 |
| 0077922 | 6/1980 | Japan | 72/16 |
| 0193216 | 11/1982 | Japan | 72/16 |
| 0064718 | 4/1985 | Japan | 72/16 |
| 62-13209 | 1/1987 | Japan . | |
| 0040110 | 2/1989 | Japan | 72/16 |

*Primary Examiner*—Lowell A. Larson
*Assistant Examiner*—Thomas C. Schoeffler
*Attorney, Agent, or Firm*—Oliff & Berridge

[57] ABSTRACT

A wet skin-pass rolling method for rolling a steel sheet by a mill while adjusting the hardness of said steel sheet through control of the rolling reduction. The method comprises determining an allowable range of reduction ratio from a predetermined desired range of hardness of the product, determining a command delivery-side sheet thickness to be obtained at the delivery side of the mill on the basis of the sheet thickness measured at the entry side of the mill, and adjusting the sheet thickness control in accordance with the command delivery-side sheet thickness.

5 Claims, 7 Drawing Sheets

HARDNESS COMPENSATED THICKNESS CONTROL METHOD FOR WET SKIN-PASS ROLLED SHEET

BACKGROUND OF THE INVENTION

1. Field of the Invention

The present invention relates to a wet skin-pass rolling method for rolling steel sheets.

2. Description of the Related Art

Hitherto, control of hardness of steel sheets, particularly steel sheets to be used in the production of tin plates, is effected by controlling the composition of the material steel in the steelmaking process or by controlling temperature and time in the annealing process. Thus, no attempt has been made to control the steel sheet hardness during skin-pass rolling. Conventionally, skin-pass rolling is conducted in a dry state with the reduction ratio controlled to a constant value which is usually not greater than 1.5%. Such dry skin-pass rolling is conducted for various purposes such as elimination of yield elongation, control of roughness of the steel sheet surface, leveling of the steel sheet and so forth.

In recent years, it has been proposed to conduct skin-pass rolling in wet condition in order to improve productivity and to simplify the process, while reducing production cost. By this method, it is easy to widely vary reduction ratio to control the hardness of product. In this case, the rolling is usually conducted at a rolling reduction of about 3 to 15%.

In order to control the hardness of a steel sheet product by wet skin-pass rolling, it is necessary not only to control the hardness of the mother steel sheet but also to keep the reduction ratio constant.

However, it is difficult to directly control the reduction ratio because of the presence of variations in the thickness of the mother steel sheet. It is, therefore, a common measure to control the reduction ratio by a method which maintains an elongation percentage constant which is computed on the basis of the steel sheet velocities at the entry and delivery sides of the rolling mill. This constant-elongation control method is disclosed, for example, in Japanese Patent Laid-Open No. 62-13209.

The above-mentioned constant-elongation method is based upon the following relationship which always exists between elongation $\epsilon$ and reduction ratio $\gamma$ due to the fact that the mass-flow of the material is always constant.

$$\epsilon=\gamma/(1-\gamma)$$

The constant-elongation method mentioned above, however, cannot precisely control the thickness of the rolled sheet, although the hardness can be controlled reasonably well.

Namely, any lack of precision in the thickness of the mother steel sheet formed during cold rolling cannot be corrected by the constant-elongation control method alone. Thus the final product sheet will exhibit a similar lack of precision in the thickness with the result that the quality of the product is seriously impaired. Conversely, a sheet thickness control alone cannot enable a hardness control although the precision of the thickness can be improved.

SUMMARY OF THE INVENTION

Accordingly, an object of the present invention is to provide a wet skin-pass rolling method which can improve precision in the thickness in the rolled sheet product while ensuring sufficiently high level of hardness of the product.

To this end, according to the present invention, there is provided a wet skin-pass rolling method for rolling a steel sheet by a mill while adjusting the hardness of the steel sheet through control of the rolling reduction, the method comprising: determining an upper limit value and a lower limit value of an allowable reduction ratio from a predetermined desired range of hardness of the product; determining a command delivery-side sheet thickness to be obtained at the delivery side of the mill on the basis of the sheet thickness measured at the entry side of the mill; and conducting the sheet thickness control in accordance with the command delivery-side sheet thickness.

The above and other objects, features and advantages of the present invention will become clear from the following description when the same is read in conjunction with the accompanying drawings.

DESCRIPTION OF THE PREFERRED EMBODIMENTS

Figure 1:
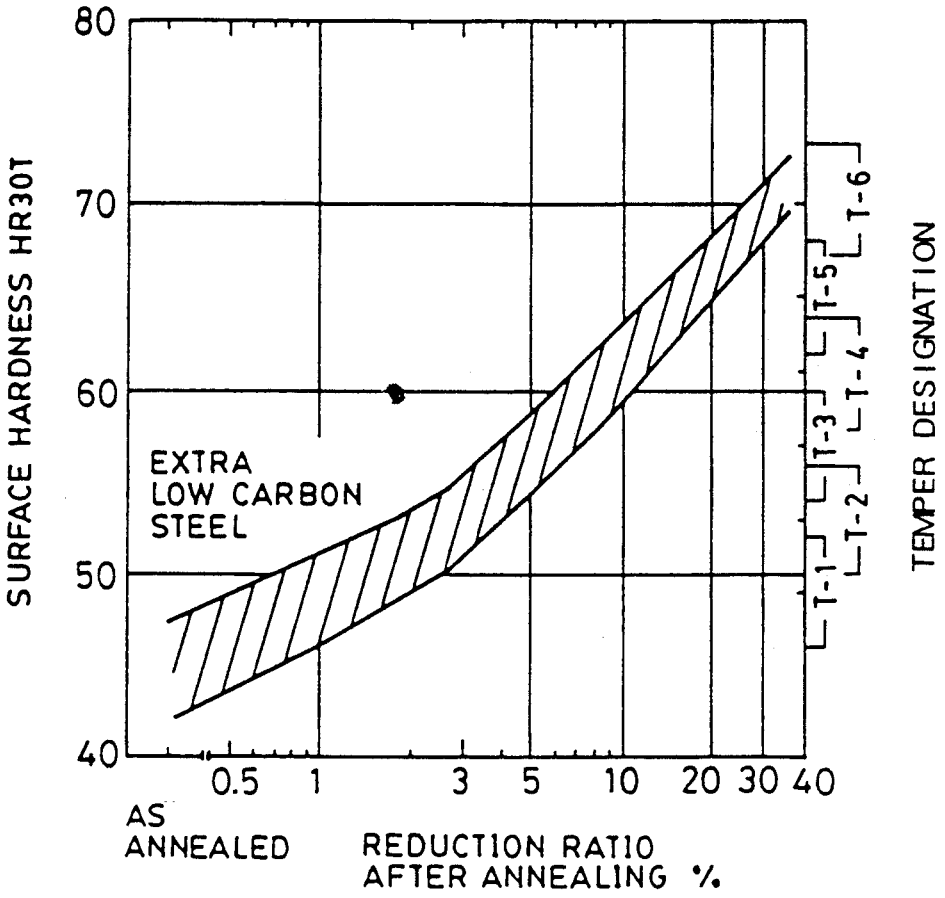
FIG. 1 is a diagram showing the relationship between reduction ratio and surface hardness of extra low carbon steel using the temper designations as a parameter.

FIG. 1 shows the relationship between the hardness of a product made of an extra low carbon steel and the reduction ratio at which the product has been skin-pass rolled. Each of the temper of designations are represented by T1 to T6. In terms of temper of designation, one-pass of rolled tin plate or steel sheet for tin plate, as specified in Japanese Industrial Standard G 3303, has about six grades in terms of the surface hardness (Rockwell T hardness: HR30T). Thus the relationship between the surface hardness and the reduction ratio cannot be expressed by a single curve but fluctuates, as shown by the hatched area, as the material of steel sheet inherently exhibits a fluctuation in the hardness. From FIG. 1, it is understood that the width of the range of fluctuation in hardness exhibited by the material of steel sheet is narrower than the allowable range after the skin-pass rolling. This suggests that a certain definite range exists in the reduction ratio which enables all the materials of steel sheet to fall within a designated range of skin-pass rolling.

For instance, in case of a material having a temper designation of T4, the surface hardness HR30T generally falls within the range 58 and 64 which, taking into account the fluctuation in the hardness of the material sheet, is obtained by rolling conducted at a reduction ratio of about 9 to 11%.

Thus, using the data shown in FIG. 1, it is possible to determine the allowable range of the reduction ratio from the desired range of surface hardness, i.e., the range within which the surface hardness is to be maintained, taking into account the fluctuation in the hardness of the material of steel sheet. Namely, it is possible to conduct the rolling to attain higher thickness precision while maintaining the surface hardness within a given desired range.

A detailed description will be given of a control system for carrying out the method of the present invention.

Figure 2A:
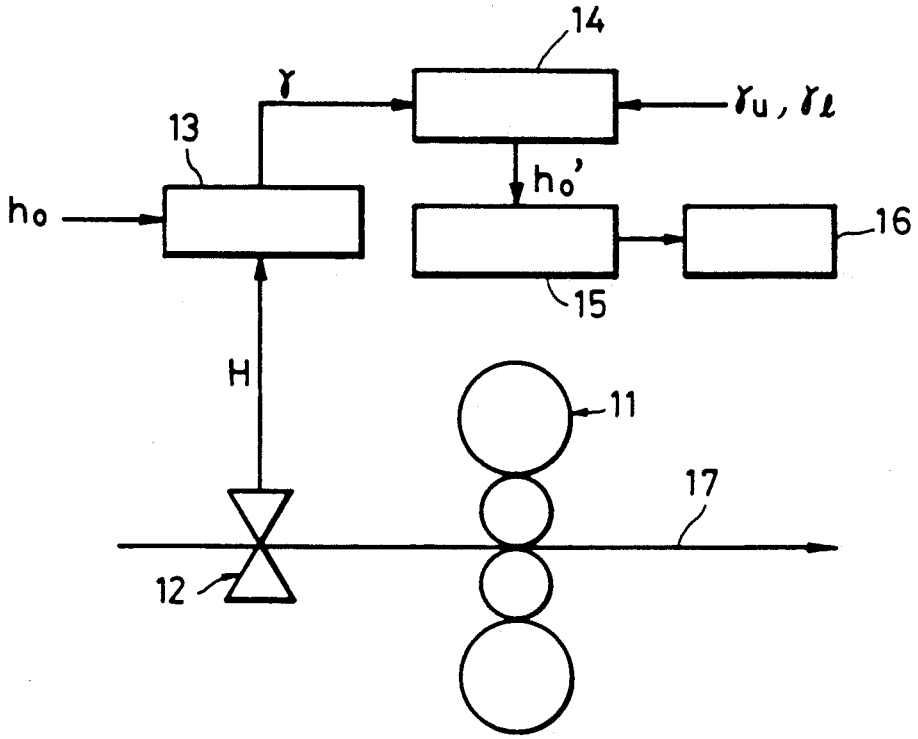
FIG. 2A is a diagrammatic illustration of a wet skin-pass rolling mill to which the present invention is applied.

FIG. 2A is a diagrammatic illustration of a wet skin-pass rolling mill system to which the present invention is applied. The rolling mill system for processing steel sheet 17 has a mill 11, a thickness sensor 12 for measuring the sheet thickness at the mill entry side, a reduction ratio computing unit 13, a command sheet thickness computing unit 14, a sheet thickness control unit 15 and a control actuator 16.

In operation, the reduction ratio computing unit 13 computes the reduction ratio $\gamma$ using formula (1) from the thickness H of the steel sheet 17 measured by the entry thickness sensor 12 at the entry side of the mill 11 and from the tentative command thickness $h_0$ to be obtained at the delivery side of the mill 11.

$$\gamma=\{(H-h_0)/H\}\times 100\ (\%) \tag{1}$$

The command sheet thickness computing unit 14 then computes $h_0'$, the command delivery-side thickness, using either method (a) or (b), below, depending on whether the reduction ratio falls within the allowable range of reduction ratio defined by a lower limit $\gamma_l$ and an upper limit $\gamma_u$.

(a) When the computed reduction ratio is within the allowable range, i.e., when the condition of $\gamma_l \leqq \gamma \leqq \gamma_u$ is met, the command thickness $h_0$ mentioned above is used directly as the command delivery-side thickness $h_0'$ to be input to the sheet thickness control unit 15. In this case, therefore, the following condition is met:

$$h_0'=h_0 \tag{2}$$

(b) When the reduction ratio does not fall within the allowable range, e.g., $\gamma<\gamma_l$ or $\gamma>\gamma_u$, the command delivery-side thickness $h_0'$ is determined in accordance with the following formulae (3) and (4). when $\gamma<\gamma_l$ $$h_0'=H\times(1-\gamma_l/100) \tag{3}$$

when $\gamma>\gamma_u$ $$h_0'=H\times(1-\gamma_u/100) \tag{4}$$

Then, the sheet thickness control unit 15 controls the control actuator 16 so as to set a sheet thickness control using the value $h_0'$ computed by the command sheet thickness computing unit 14 as the command value of the thickness to be obtained at the delivery side of the mill. The control actuator 16 may be of a type which controls the rolling reduction, tension or the velocity.

The control may be conducted by feed-forward or feedback control method, using the command delivery-side sheet thickness $h_0'$ as the control command.

Figure 2B:
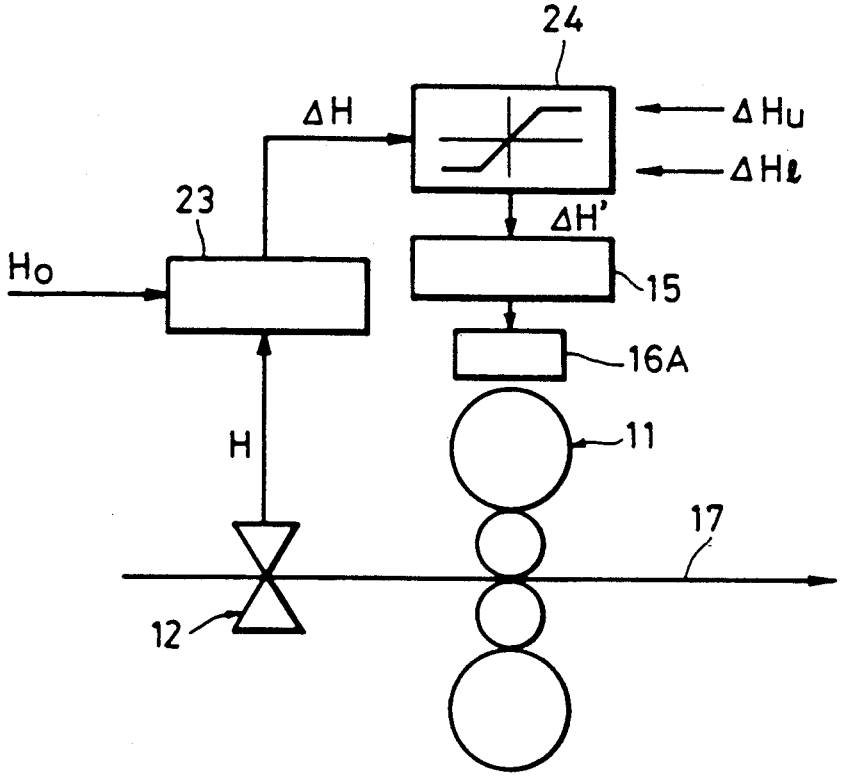
FIG. 2B is a system diagram of a practical example of a wet skin-pass rolling mill embodying the present invention.

FIG. 2B shows a mill system in which the sheet thickness is controlled by feed-forward method using a control actuator capable of controlling the rolling reduction. This system has a mill 11, a sheet thickness sensor 12, a sheet thickness control unit 15, a rolling reduction control actuator 16A, an entry-side thickness deviation computing unit 23 and command entry-side thickness deviation computing unit 24.

The entry-side thickness deviation computing unit 23 receives a signal indicative of the thickness of the steel sheet 17 actually measured by the thickness sensor 12 at the entry side of the mill 11 and a signal indicative of an entry-side set theoretical, or rated, thickness $H_0$, and computes the deviation $\Delta H$ of the steel thickness H from the set value $H_0$ at the entry side of the mill 11.

The command entry-side thickness deviation computing unit 24 sets a correctable entry-side thickness deviation $\Delta H'$, depending on whether the value $\Delta H$ of the entry-side thickness deviation based upon the measured value falls within an allowable range of the entry-side thickness deviation which is determined by a pre-programmed lower limit value $\Delta H_l$ and an upper limit value $\Delta H_u$.

The sheet thickness control unit 15 then computes the reduction roll position using, as the new command of the thickness deviation at the entry side, the entry-side thickness deviation $\Delta H'$ computed by the command entry-side thickness computing unit 24. The sheet thickness control unit 15 then controls the rolling reduction control actuator 16A to control the sheet thickness by a feed-forward control.

Figure 2C:
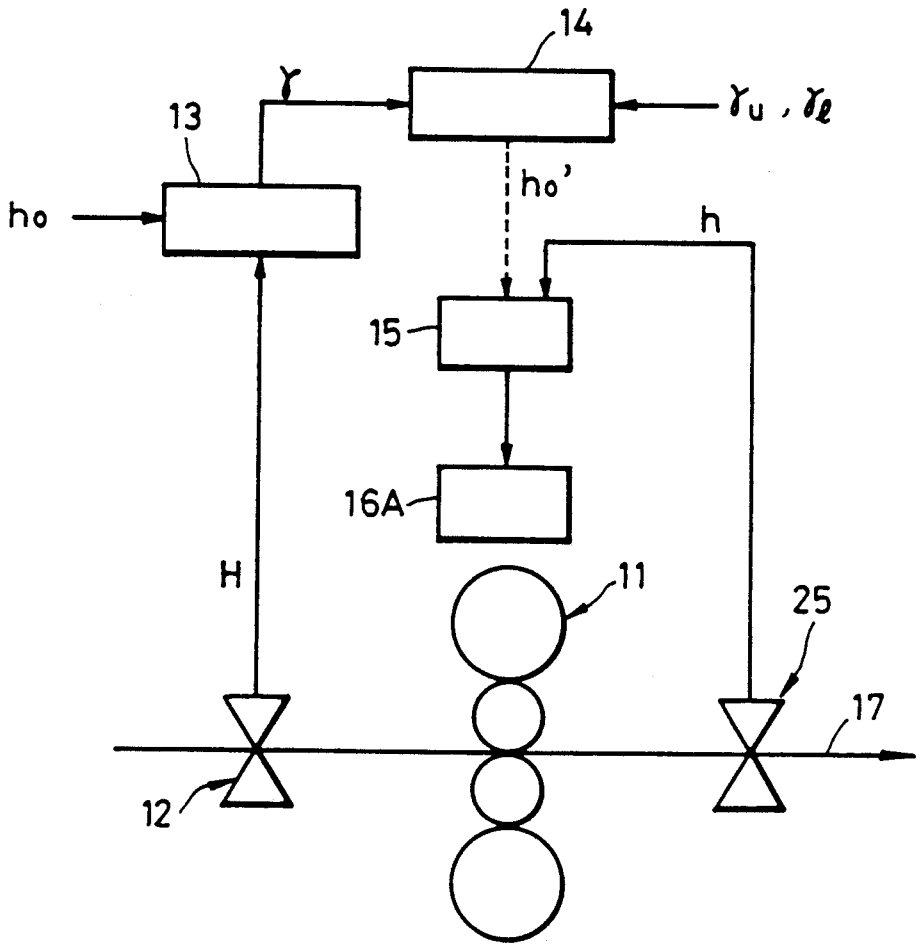
FIGS. 2C, 2D and 2E are system diagrams of different wet skin-pass rolling mills to which the present invention is applied.

FIG. 2C shows a mill system in which the sheet thickness is feedback-controlled by a control actuator of a type which controls the rolling reduction. The system has a mill 11, an entry-side thickness sensor 12, a reduction ratio computing unit 13, a command sheet thickness computing unit 14, a sheet thickness control unit 15, a rolling-reduction control actuator 16A, a delivery-side thickness sensor 25, and a steel sheet 17.

More specifically, the reduction ratio computing unit 13 computes the reduction ratio $\gamma$ in accordance with the formula (1) mentioned before, on the basis of the sheet thickness H actually measured by the thickness sensor 12 at the entry side of the mill 11 and the desired command thickness $h_0$ to be obtained at the delivery side of the mill 11.

The command sheet thickness computing unit 14 then computes $h_0'$, the command delivery-side sheet thickness, for each rolled material, using method (a) or method (b) previously described, depending on whether the reduction ratio $\gamma$ computed by the reduction ratio computing unit 13 falls within the allowable range of rolling reduction defined by the lower and upper limits $\gamma_l$ and $\gamma_u$.

This change in the command value of the sheet thickness to be obtained at the mill delivery is executed when the portion of the steel sheet which was measured by the entry-side thickness sensor 12 has reached the position of the delivery-side thickness sensor 25.

The sheet thickness control unit 15 then computes a roll-gap changing amount $\Delta S$ as the delivery-side thickness deviation to be corrected, i.e., as the value necessary for eliminating the deviation of the delivery-side sheet thickness h measured by the delivery-side thickness sensor 25 from the command delivery-side sheet thickness $h_0'$ set by the command sheet thickness computing unit 14. Then, the rolling-reduction control actuator 16A operates to effect a change in the roll gap in accordance with the changing amount ΔS.

The system shown in FIG. 2C may be used in combination with the system shown in FIG. 2B which performs a feed-forward control by determining the command delivery-side sheet thickness $h_0'$ directly from the entry-side thickness sensor 12.

Figure 2D:
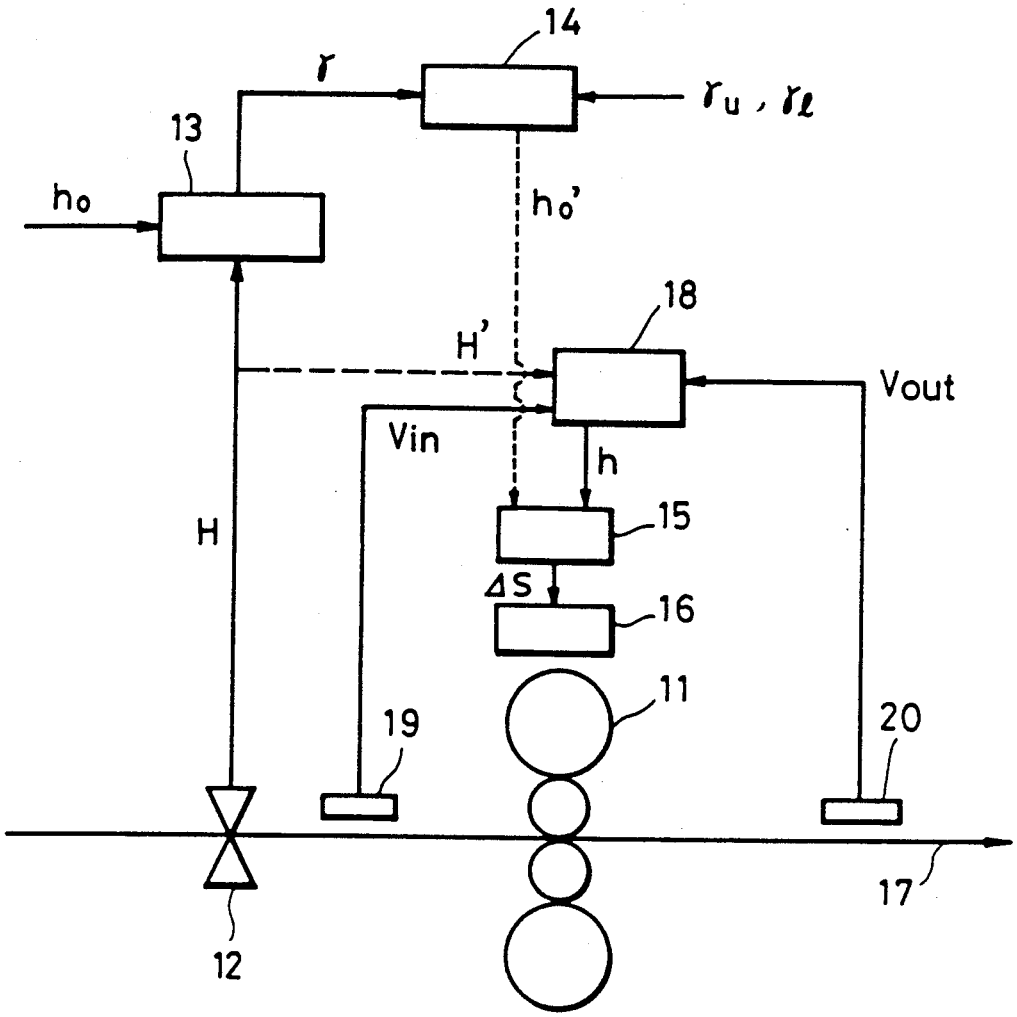

FIG. 2D shows another wet skin-pass rolling mill system to which the present invention is applied. This system has a mill 11, a thickness sensor 12, a reduction ratio computing unit 13, a command sheet thickness computing unit 14, a sheet thickness control unit 15, a reduction control actuator 16, a mass-flow sheet thickness computing unit 18, an entry-side velocity meter 19 and a delivery-side velocity meter 20. Numeral 17 denotes the steel sheet being rolled.

The reduction ratio computing unit 13 computes the reduction ratio $\gamma$ from the sheet thickness H actually measured by the thickness sensor 12 at the entry side of the mill 11 and the desired command thickness $h_0$ and conducts the same operation as described in connection with FIG. 2A. The change of the command delivery-side thickness $h_0'$ is effected when the portion of the steel sheet which was measured by the entry-side thickness sensor 12 has reached a position immediately under the mill.

On the other hand, the mass-flow thickness computing unit 18 computes a mass-flow thickness h in accordance with formula (5) using the velocity $V_{in}$ of the steel sheet at the entry side of the mill as measured by the entry-side velocity meter 19, the velocity $V_{out}$ of the sheet as measured by the delivery-side velocity meter 20, and a sheet thickness H' at a portion immediately upstream of the mill as predicted from the entry-side thickness H measured by the entry-side thickness sensor 12.

$$h = V_{out}/V_{in} * H' \quad (5)$$

The prediction of the sheet thickness H' immediately upstream of the mill from the entry-side thickness H can be obtained as follows. The distance between the entry-side thickness sensor 12 and the mill 11 is represented by L. The time required for the portion of the sheet to travel from the position of the entry-side thickness sensor 12 to the portion immediately under the mill is represented by $L/V_{in}$ seconds. Therefore, the thickness H measured at a moment which is $L/V_{in}$ ahead can be used as the present value of the sheet thickness at position immediately upstream of the mill.

The thickness control unit 15 then computes a roll-gap changing amount ΔS which is necessary for eliminating the deviation of the mass-flow thickness h from the above-mentioned command delivery-side thickness $h_0'$ and the rolling reduction control actuator 16 performs the thickness control in accordance with the computed value of the roll-gap changing amount.

Figure 2E:
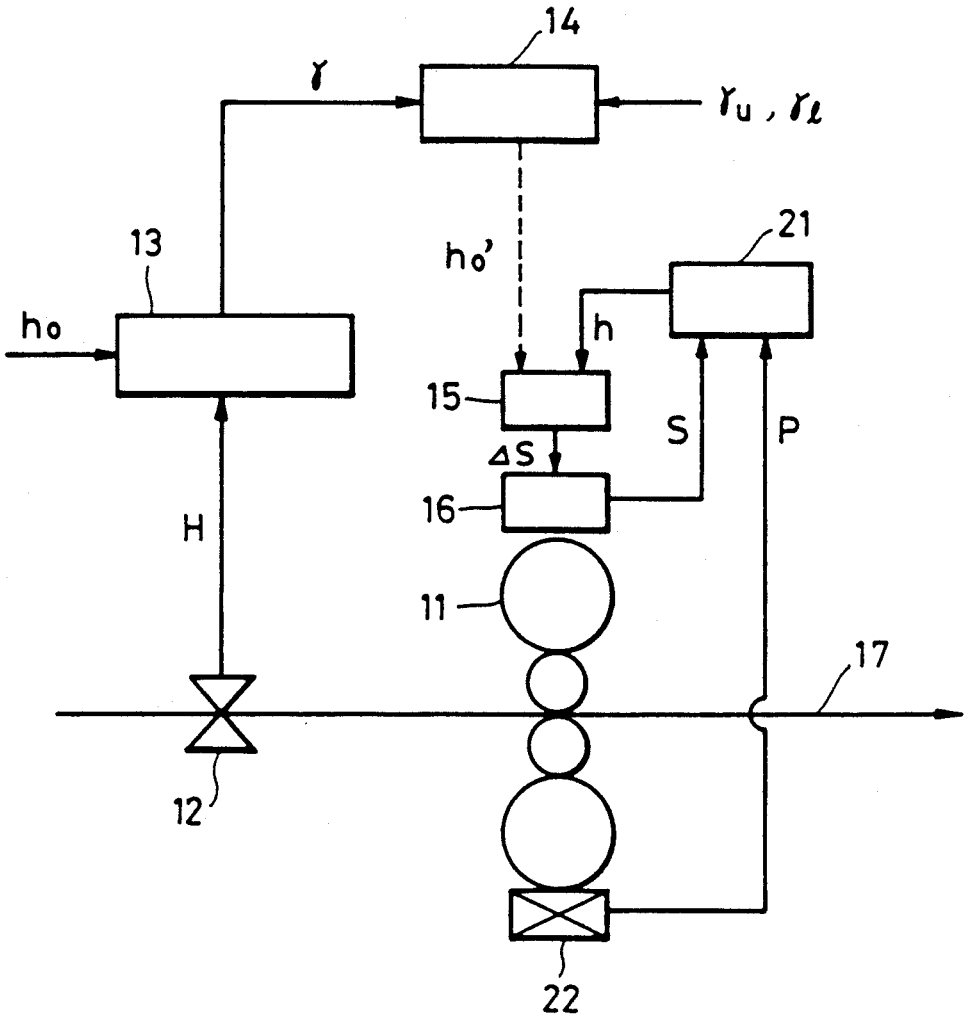

FIG. 2E is a system diagram showing a different wet skin-pass rolling mill system to which the present invention is applied. The system has a mill 11, a thickness sensor 12, a reduction ratio computing unit 13, a command sheet thickness computing unit 14, a sheet thickness control unit 15, a rolling reduction control actuator 16, a gauge meter thickness computing unit 21 and a load meter 22. Numeral 17 denotes a sheet steel being rolled. The operation of this system is substantially the same as that of the system shown in FIG. 2A.

The gauge meter thickness computing unit 21 computes the gauge meter thickness h in accordance with formula (6) on the basis of the roll gap value S obtained from the rolling reduction control unit 16 and a load value P measured by the load meter 22.

$$h = S + (P/M) + S_0 \quad (6)$$

where M represents the rigidity of the mill and $S_0$ represents the roll gap correction amount.

The thickness control unit 15 then computes a roll-gap changing amount ΔS, which is necessary for eliminating the deviation of the gauge meter thickness h from the command delivery-side thickness $h_0'$, and the rolling reduction control actuator 16 then conducts control of the sheet thickness in accordance with the thus determined changing amount ΔS.

Figure 3:
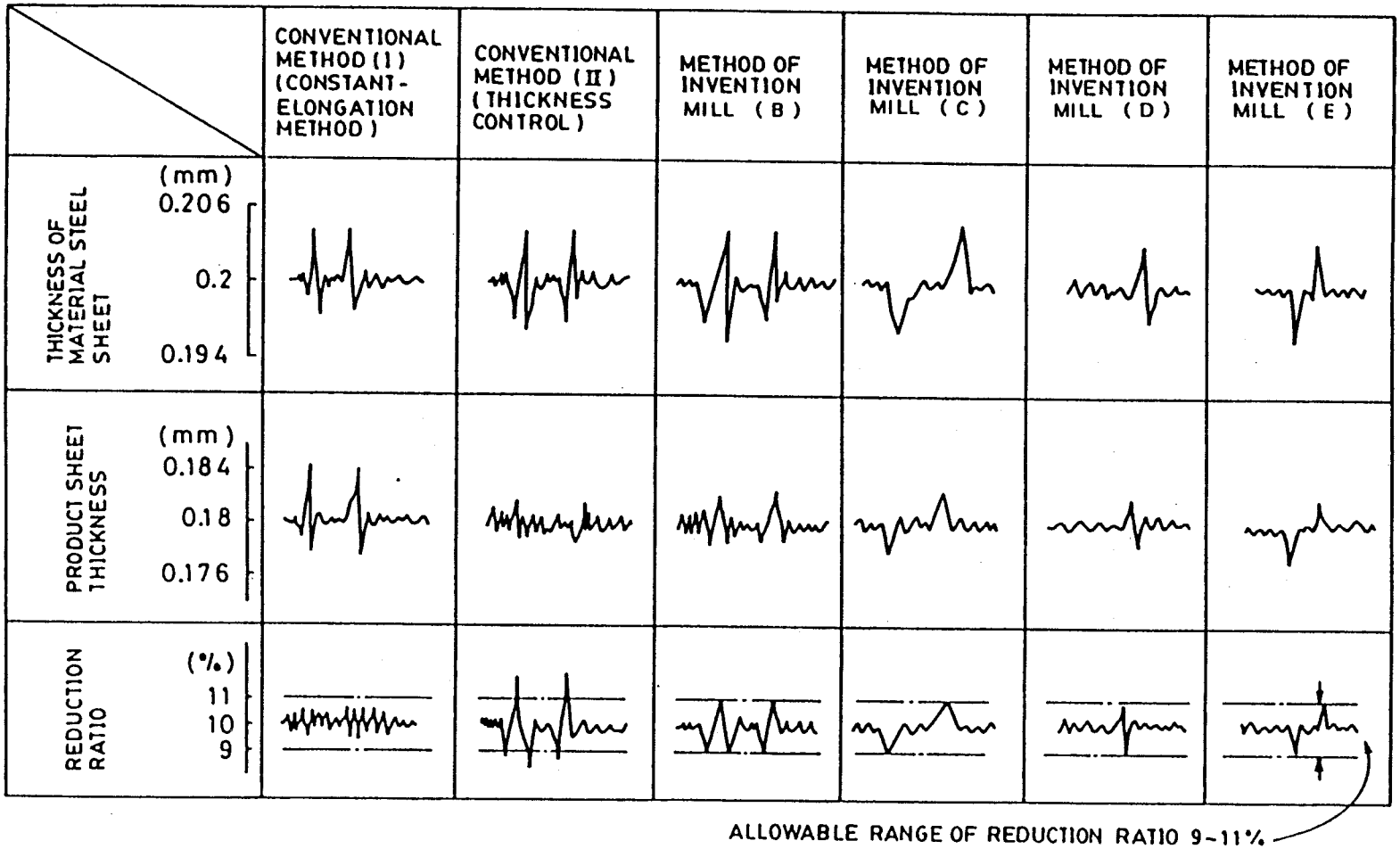
FIG. 3 is a table comparing the result of the wet skin-pass rolling method of the present invention used in the mills of FIGS. 2B–2E, with the results of conventional skin-pass rolling methods (I) and (II).

FIG. 3 is a table showing the results of skin-pass rolling operations conducted starting with an extra low carbon steel sheet 0.2 mm thick and 800 mm wide, conducted at a temper designation T4, i.e., a reduction ratio of 10% (allowable reduction ratio range 9 to 11%), when the rolling was conducted using mill systems of types B to E which correspond to the embodiments shown in FIGS. 2B to 2E, respectively, together with the results of rolling operations conducted by a conventional method (I) which relied solely upon constant-elongation control and a conventional method (II) which used an ordinary sheet thickness control.

In conventional method (I), the fluctuation in the reduction fell within a range of 9.5% and 10.5% but the fluctuation of the sheet thickness was as great as 2.5% due to fluctuation in the thickness of the starting steel sheet. In conventional method (II), the fluctuation in the thickness was as small as ±1% by virtue of the thickness control. In this case, however, the reduction ratio varied greatly so as to fall out of the allowable range at some portions of the rolled sheet resulting in an unevenly hardened surface of the rolled steel sheet.

Using the methods embodied in mill systems (B) to (E), of the present invention, the portion of the starting steel sheet where the thickness fluctuation is small, the thickness of the rolled steel sheet is maintained within a range of ±1% deviation from the desired command thickness because thickness control was effected without restriction in such portion of the sheet. Even where the greatest fluctuation in thickness of the starting steel sheet was observed, the result in rolling mill systems (B) to (E) was much less thickness fluctuation in the rolled sheet steel than that observed in the conventional method (I). Further, although mill systems (B) to (E) of the present invention had reduction ratio fluctuation greater than that in conventional method (I), the fluctuation never exceeded the allowable range of rolling reduction. Thus, the product had a greater uniformity of thickness than did the products of conventional method (I) in addition to having a surface hardness within the desired range. In addition, the products of mill systems (B) through (E), although showing slightly greater variation in thickness than the products of conventional method (II), were always produced within the desired range of reduction thereby having the desired surface hardness, unlike the products of conventional method (II).

As has been described, according to the method of the present invention, it is possible to conduct a wet skin-pass rolling of a steel sheet in such a manner as to improve the precision of the sheet thickness while adjusting the hardness of the product through a control of the reduction ratio. It is therefore possible to improve the quality of products such as steel sheets as the material of tin plates.

What is claimed is:

1. A wet skin pass rolling method in which the hardness of a rolled material is controlled by a 3 to 15% change in the rolling reduction, said method comprising: calculating a rolling reduction $\gamma$ in accordance with the following formula (1) on the basis of the inlet material thickness H (mm) at the inlet side of a rolling mill and the command outlet material thickness $h_0$ (mm) to be obtained at the outlet side of said rolling mill; comparing the calculated rolling reduction $\gamma$ with an upper limit value $\gamma_u$ of the rolling reduction and a lower limit value $\gamma_l$ of the rolling reduction determined by the surface hardness of the material to be obtained; and determining the final command outlet thickness $h_0'$ in accordance with the following formulae (2) to (4):

$$\gamma=\{(H-h_0)/H\}\times 100\ (\%) \quad (1)$$

$$\gamma_l \leqq \gamma \leqq \gamma_u : h_0' = H \quad (2)$$

$$\gamma < \gamma_l : h_0' = H \times \{1-(\gamma_l/100)\} \quad (3)$$

$$\gamma > \gamma_u : h_0' = H \times \{1-(\gamma_u/100)\} \quad (4).$$

2. A wet skin-pass rolling method according to claim 1, wherein said sheet thickness control is conducted by a feed-forward method by using an entry-side thickness deviation determined on the basis of the sheet thickness measured at the entry side of said mill so as to obtain said command delivery-side sheet thickness at the delivery side of said mill.

3. A wet skin-pass rolling method according to claim 1, wherein said sheet thickness control is conducted by a feedback control on the deviation of a sheet thickness measured at the delivery side of said mill from said command delivery-side thickness.

4. A wet skin-pass rolling method according to claim 1, wherein said sheet thickness control is conducted on the basis of the deviation from said command delivery-side thickness of a thickness of the sheet immediately under the mill computed from sheet velocities measured both at the entry and delivery side of said mill.

5. A wet skin-pass rolling method according to claim 1, wherein said sheet thickness control is conducted on the basis of the deviation from said command delivery-side thickness of a thickness of the sheet immediately under the mill computed from the roll gap in said mill and the level of the rolling load.

* * * * *